US007480944B2

(12) United States Patent
Nascimento

(10) Patent No.: US 7,480,944 B2
(45) Date of Patent: Jan. 27, 2009

(54) WRIST CLOSURE SYSTEM FOR AN ATHLETIC GLOVE

(75) Inventor: Christopher Nascimento, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 138 days.

(21) Appl. No.: 11/154,948

(22) Filed: Jun. 17, 2005

(65) Prior Publication Data

US 2007/0000019 A1 Jan. 4, 2007

(51) Int. Cl.
*A41D 19/00* (2006.01)

(52) U.S. Cl. ..... 2/162; 2/159

(58) Field of Classification Search ..... 2/159, 2/160, 162, 161.1, 16, 158, 161.5, 161.6, 2/164, 167, 170
See application file for complete search history.

(56) References Cited

U.S. PATENT DOCUMENTS

| | | | | | |
|---|---|---|---|---|---|
| 970,958 | A * | 9/1910 | Schulherr et al. | ..... | 2/169 |
| 1,763,813 | A * | 6/1930 | O'Neil | ..... | 2/162 |
| 1,900,395 | A * | 3/1933 | Gitt | ..... | 2/19 |
| 3,119,118 | A * | 1/1964 | Beebe | ..... | 2/162 |
| 4,864,660 | A * | 9/1989 | Sawyer | ..... | 2/20 |
| 4,868,927 | A * | 9/1989 | Bourdeau et al. | ..... | 2/161.1 |
| 5,406,649 | A * | 4/1995 | Bolembach | ..... | 2/158 |
| 5,500,956 | A | 3/1996 | Schulkin et al. | | |
| 5,867,830 | A * | 2/1999 | Chen | ..... | 2/161.1 |
| 6,061,833 | A * | 5/2000 | Smith et al. | ..... | 2/162 |
| 6,085,354 | A | 7/2000 | Wilder et al. | | |
| 6,721,960 | B1 * | 4/2004 | Levesque et al. | ..... | 2/161.1 |
| 2003/0101501 | A1 * | 6/2003 | Sullivano et al. | ..... | 2/19 |
| 2004/0216207 | A1 * | 11/2004 | Anderson | ..... | 2/19 |

* cited by examiner

*Primary Examiner*—Gary L Welch
*Assistant Examiner*—Richale L Quinn
(74) *Attorney, Agent, or Firm*—Plumsea Law Group, LLC

(57) ABSTRACT

A self-closing wrist closure system and an athletic glove using the closure system. The closure system comprises an elastic member contained within a casing and anchored at first and second anchor points within the casing and extending between the two anchor points. The casing defines a slit along the wrist circumference side extending into the glove body to enable expansion of the wrist opening. The wrist closure system is adapted to enable a wearer's hand to enter the glove by stretching of the elastic member and spreading of the slit and then to cinch around the wearer's hand by recovery of the elastic member and narrowing of the slit.

21 Claims, 6 Drawing Sheets

WRIST CLOSURE SYSTEM FOR AN ATHLETIC GLOVE

BACKGROUND OF THE INVENTION

1. Field of the Invention

A self-closing closure system for an athletic glove that expands as a wearer's hand enters the glove and then recovers to cinch around the wearer's wrist and provide a secure, flexible fit.

2. Background of the Invention

Athletes wear close-fitting athletic gloves for a range of sports such as American football, baseball, and golf. These close-fitting gloves are generally made of a material thin enough to be tactile but whose closure system must be tight so that the motion of the wearer's hand during the activity will not loosen the fit of the glove or cause the wearer to lose their grip on a ball, bat or club. Generally, such close-fitting gloves are made of a range of materials such as leather or high performance synthetic materials with very similar closure systems. Typically the closure systems have included two piece wrist closures with mating sides of hook and loop fastener material such as Velcro™ supplied on the facing portions. Generally, hook and loop fasteners are able to provide a custom fit but in certain situations can be cumbersome to wrap around the wrist to get a secure fit. Since the wearer can only use one hand to put on the glove by definition, the two piece closure has presented some difficulties in some sports. The wearer may be able to attain a secure fit by applying the glove with one hand, but often the mating hook and loop portions are misaligned causing the edges of the glove to be uneven and cause discomfort to the wearer. Due to these difficulties, athletes must sometimes get help in securing their gloves and ensuring that the hook and loop portions are correctly aligned from trainers. Another drawback to hook and loop fasteners is that in the field, grass, dirt and other materials can get caught on them, particularly the hook portion. The hook portion also tends to stick easily to other things such as clothing and other equipment. Also, over time, the hook and loop fastener can wear out and not provide as secure a fit as when new. This is particularly true when the hook portion of the fastener catches on things and becomes clogged with fibers and other materials preventing the loop side from catching securely.

A performance drawback of the typical hook and loop fastener is that since two thicknesses of material must mate for the fastener to work, there is an area on the wrist that is generally stiffer than desired. The hook portion of these types of fasteners is generally made of a stiff material. Coupled to the loop portion, the resulting mated fastener is generally thick and stiff. In many sports, the wrist area is where the athletes want increased flexibility, and the mating hook and loop closure can present an obstacle to the free movement of the athlete's wrist.

SUMMARY

The closure system of the present invention avoids the drawbacks of prior art hook and loop fasteners by employing a heavy duty, high recovery elastic that extends around at least a portion of the wrist within a sleeve or casing. The sleeve acts as a guide and pathway for the elastic and also protects the wearer's skin from chafing from movement of the elastic therein. The closure system is self-opening and self-closing in that it is a one piece unit avoiding the need for two handed application of a mating closure. The elastic expands sufficiently for the hand of a wearer to enter the glove comfortably, and then recovers sufficiently to cinch the wrist opening of the glove around the wearer's wrist securely. The closure system stretches enough to enable a hand to enter the glove and recovers well to create a seal around the wrist. The closure system is self-closing since it automatically closes on itself. In its relaxed state the elastic enables the size of the opening to be made smaller than typical gloves since the closure system allows increased opening and closing capacity. This gives a secure fit to a wider range of wearers, particularly for undersized or oversized hands relative to the size of the wrist.

The sleeve and elastic are both fabric with less rigidity than conventional hook and loop materials, particularly when mated together, so as not to hinder the flexibility of the wrist. Also, the sleeve and elastic provide a supple, sleek look to the glove without a rigid, board-like area. Since the closure is a single piece, there is no need to line up mating sides of a fastener and to use another hand to adjust the fit of the glove around the wearer's wrist. The elastic and sleeve may be anywhere along the circumference of the wrist. Preferably the elastic is anchored within the sleeve on the medial side, that is, the thumb side. The elastic extends through the sleeve on the palm side of the wrist, and is anchored again on the lateral side, that is, the fifth or little finger side. In this manner, for most applications, the elastic extends about 180° around the wrist. In certain applications, it may be useful for the elastic to extend further around the wrist by encircling the medial and lateral points of the wrist and being anchored on the top side of the hand within the sleeve thus extending about 270° around the wrist.

The sleeve is a comfortable material such as Spandex™ or Neoprene™ with some recovery properties so that the sleeve will stretch and cinch some. Most of the stretch and recovery is accomplished by the elastic within the sleeve.

In one embodiment, the glove is designed so that the elastic is anchored on the medial side within the sleeve. On the lateral side however, the body of the glove and the sleeve are finished with a slit or keyhole to enable expansion of the opening. The elastic extends outside of the sleeve when stretched. When the elastic is in the resting position, the slit is generally closed, but when the elastic is stretched, the elastic is visible as the slit parts.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
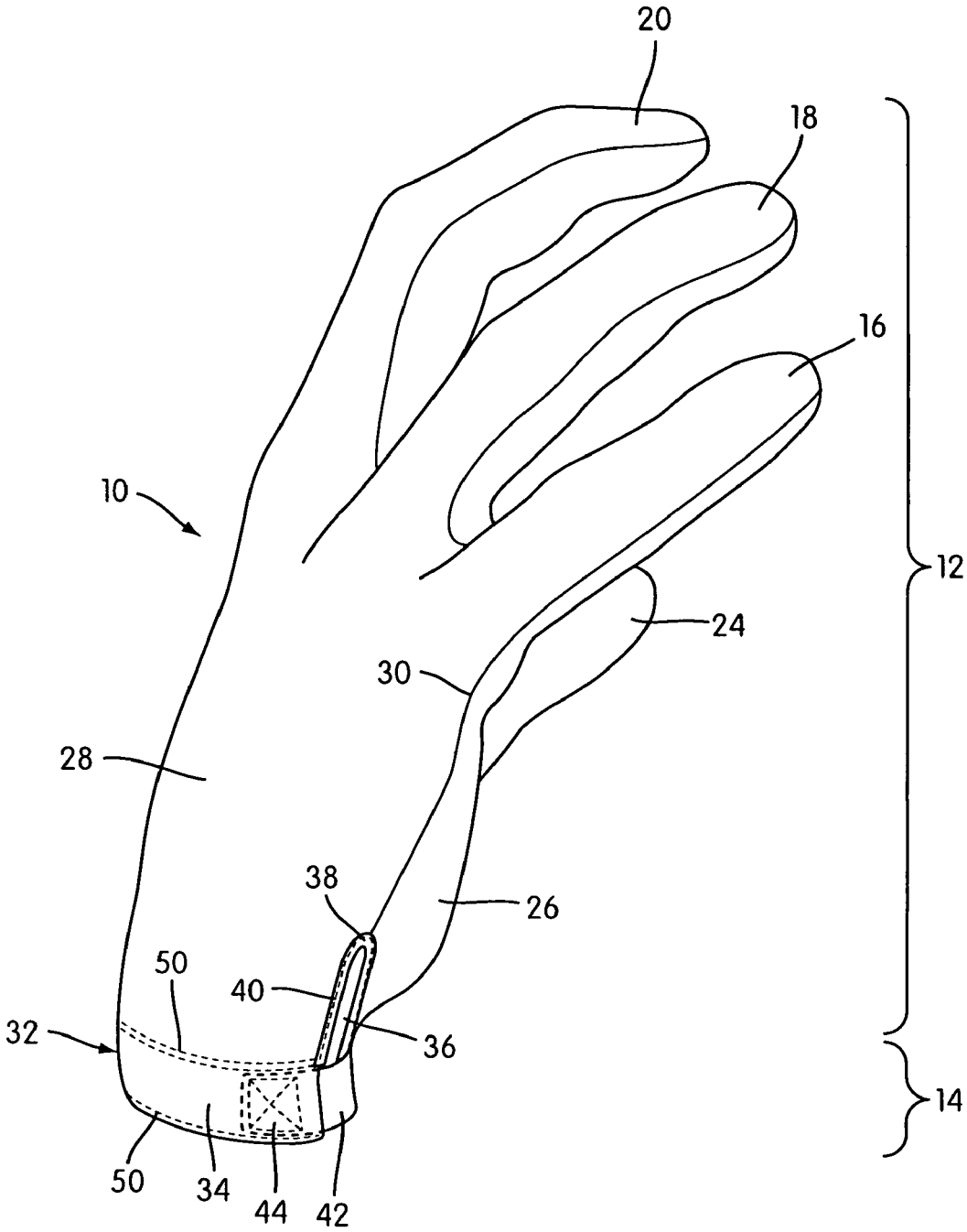
FIG. 1 is a perspective view of a glove according to one embodiment of the invention in a resting state.
Figure 2:
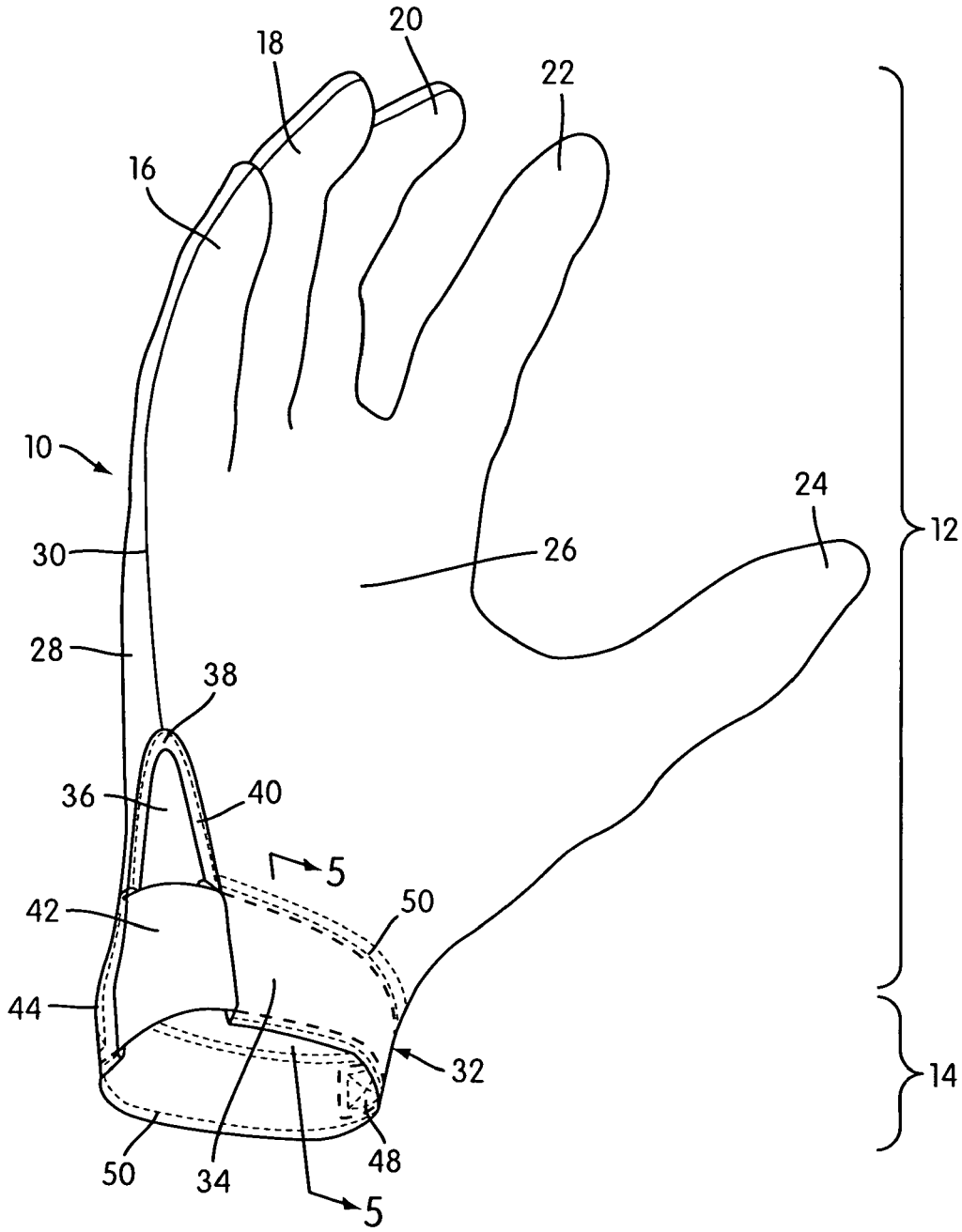
FIG. 2 is a perspective view of the glove of FIG. 1 during wear, illustrating the palm side of the glove.
Figure 3:
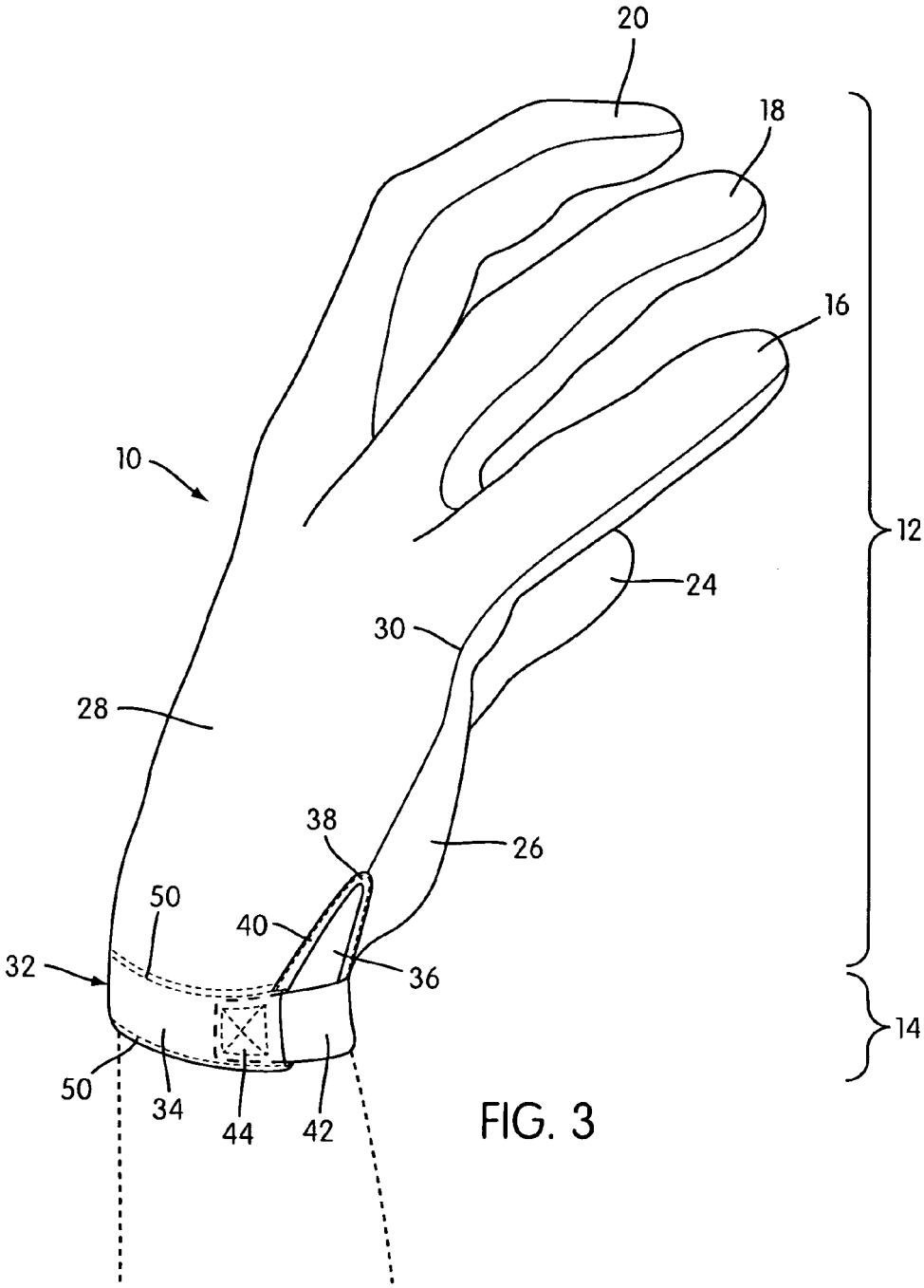
FIG. 3 is another perspective view of the glove of FIG. 1 during wear, illustrating the back side of the glove.
Figure 4:
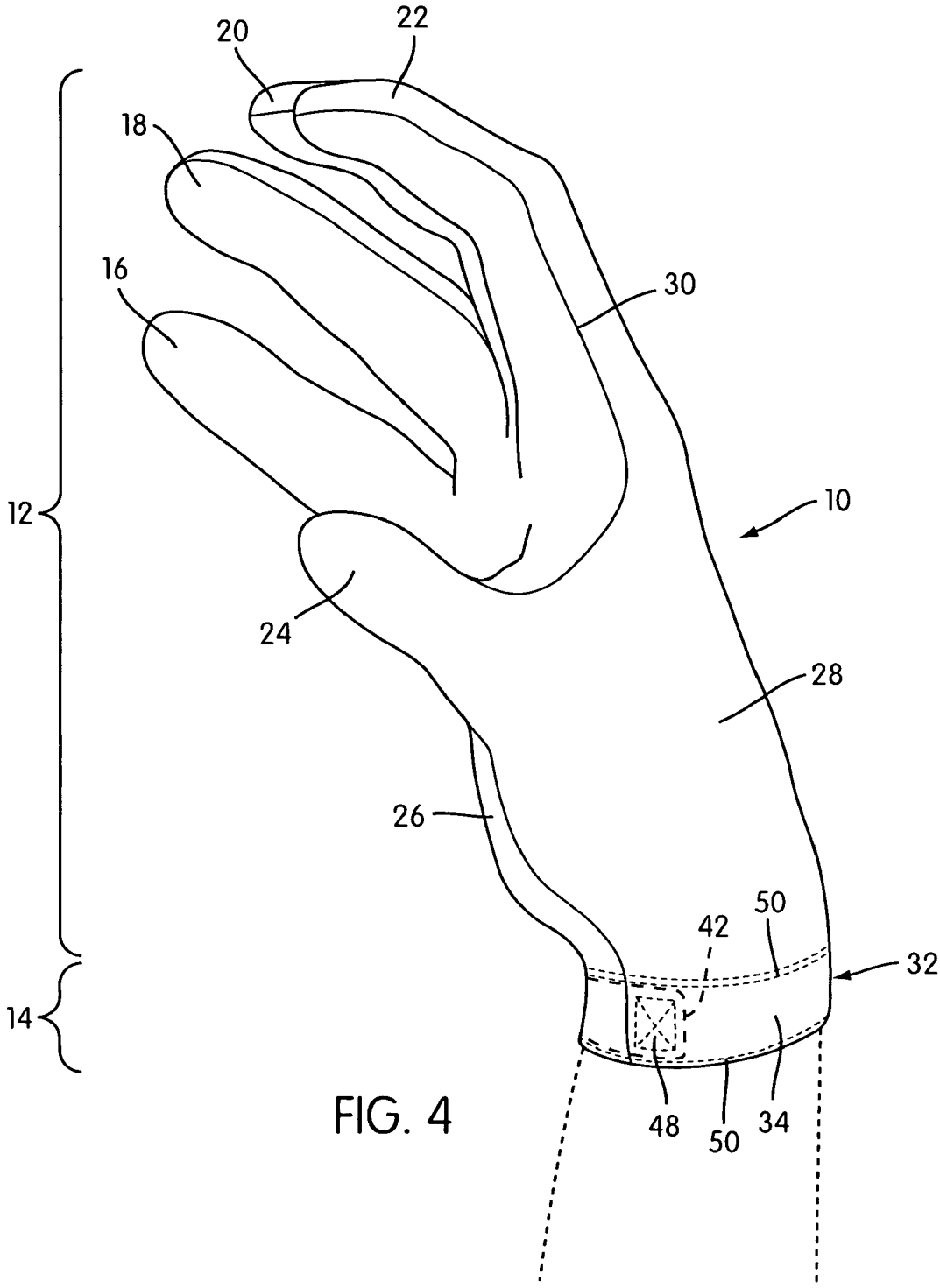
FIG. 4 is a perspective view of the glove of FIG. 1 from a perspective opposite that of FIG. 3.

FIGS. 1-4 are perspective views of a glove 10 according to one embodiment of the invention. FIG. 1 illustrates glove 10 in its resting state prior to wear, while FIG. 2 illustrates the glove in position on the hand of a user. FIGS. 3 and 4 are perspective views taken from opposite sides of glove 10. As shown in the figures, glove 10 is comprised of two major sections, glove body portion 12 and wrist portion 14.

Glove body portion 12 defines four finger portions, little finger portion 16, ring finger portion 18, middle finger portion 20 and index finger portion 22, and a thumb portion 24. For purposes of this description, a lateral side is defined to be proximate to fifth or little finger portion 16, and a medial side is defined to be proximate to thumb portion 24. Although the figures show full finger portions, it is within the scope of the invention to provide partial finger portions to the glove body. Glove body portion 12 also includes a palm side 26 and a back side 28. Back side 28 is more clearly shown in FIG. 3, in which glove 10 is shown from a back side perspective.

Palm side 26 and back side 28 of glove body 12 are typically made of Spandex™, Neoprene™, or any other material that can absorb sweat, provide the user with tactility and a good grip, and conform to the user's hand. In the illustrated embodiment, palm side 26 and back side 28 of glove body 12 are joined by stitching at a stitch line 30 that extends from the lateral side of glove 10, tracing the tips of finger portions 16, 18, 20, 22 and thumb portion 24 to the medial side of glove 10. However, although stitch line 30 is shown in FIGS. 1-3, palm side 26 and back side 28 may be joined in any other suitable manner, including with adhesives or by fusing. Alternatively, in some cases palm side 26 and back side 28 may be formed integrally, such that there is no stitch line joining them.

Either or both of palm side 26 and back side 28 may include material to increase the gripping properties, insulative characteristics, or protective characteristics of glove 10. Many types of these materials are known in the art. One particular example is synthetic leather made with polyvinyl chloride. Although palm side 26 and back side 28 are illustrated as being comprised of unitary pieces of fabric, palm side 26 and back side 28 may be comprised of any number of pieces or sections, joined together in any suitable fashion. For example, either or both of palm side 26 and back side 28 may include either insulation to protect the user from cold or vents to provide some measure of relief from heat, depending on the embodiment and the application in which glove 10 is to be used.

Wrist portion 14 includes a self-closing wrist closure 32 that expands over the user's hand when the hand enters glove 10 and then recovers and cinches against the user's wrist to hold glove 10 securely in position. Wrist closure 32 comprises a sleeve or casing 34, which extends around at least a portion of wrist portion 14 and forms a slit or keyhole 36 at a point along the circumference. As shown in FIGS. 1-3, slit 36 is generally V-shaped and extends into glove body portion 14, with the terminus 38 of slit 36 aligned with stitch line 30. At its edges, slit 36 is finished with piping 40. Slit 36 enables the opening of the glove to expand sufficiently for a hand to enter the glove. The exact length of slit 36 can vary from glove size to glove size, but the slit must extend into the glove body portion some distance in order for the glove to expand sufficiently. The stretch and recovery characteristics of the elastic member coupled with the spreading of the slit enable even oversized hands to don the glove easily, and cinch around the wrist by recovery of the elastic and narrowing of the slit. In the figures, slit 36 is shown on the lateral side of the glove and wrist portion, but could be located anywhere along the circumference of the wrist portion. In addition, slit or keyhole 36 could also be constructed to include a stretch material proximate terminus 38 so that the wearer's hand is covered as much as possible. The terms "slit" or "keyhole" are used herein to refer both to an actual physical separation or a keyhole area which is constructed with another material to enable the glove body to stretch.

Sleeve 34, like the rest of glove 10, is made of a relatively soft, flexible fabric without significant rigidity and with at least some stretch and recovery characteristics. Depending on the embodiment, sleeve 34 may comprise the same fabric as palm side 26 and back side 28 and, moreover, may be formed of fabric from those two sections, folded over and sewn so as to form a fold of fabric that defines an interior channel. Alternatively, sleeve 34 may be made of entirely different materials and attached to glove body portion 12. In some embodiments, different portions of sleeve 34 may be made of different materials. For example, sleeve 34 may be made of Spandex™ in the portions contiguous with the interior of palm side 26 and of Neoprene™ on the exterior in the portions contiguous with the exterior of palm side 26.

Encased within and extending around the interior of at least a portion of sleeve 34 is a high stretch, high recovery elastic member 42, which is best seen in FIGS. 2 and 4. An example of a material that could be used for elastic member 42 is a crush-proof elastic containing 46% nylon, 28% lycra and 26% polyester which is available is varying widths. Any suitable width can be used depending on the design and size of the wrist closure area. Elastic member 42 is shown as a unitary piece of elastic material, however member 42 could be comprised of a group of elastic strands or the like to provide sufficient stretch and recovery characteristics. Elastic member 42 could also be made of any material or combination of materials having suitable stretch and recovery characteristics.

Figure 5:
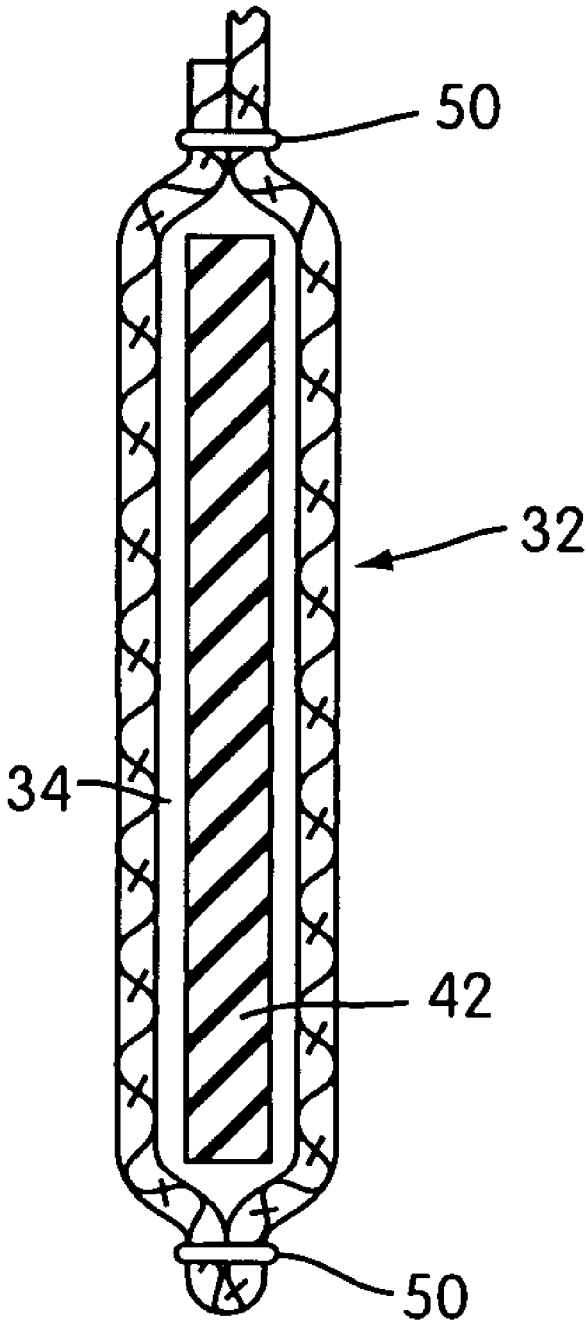
FIG. 5 is a sectional view of the wrist portion of the glove of FIG. 1, taken through Line 5-5 of FIG. 2.

Elastic member 42 is typically anchored at two or more anchor points 44, 48 and extends between those anchor points. In some embodiments, a first anchor point 44 is disposed on the lateral side of glove 10 proximate to slit 36, a second anchor point 48 is disposed on the medial side of glove 10, and elastic member 42 extends between the first and second anchor points 44, 48. Taking the location of slit 36 as 0° around the circumference of sleeve 34, elastic member 42 typically extends within sleeve 34 over about 180° of the circumference of the wrist. FIG. 5 is a cross-sectional view taken through Line 5-5 of FIG. 2, illustrating elastic member 42, sleeve 34, and stitching 50 that defines the upper and lower boundaries of sleeve 34.

In FIGS. 3 and 4, first and second anchor points 44, 48 are illustrated as points where stitching extends through sleeve 34 and elastic member 42 to anchor elastic member 42. The illustrated pattern is that of a stitched rectangle with stitched diagonals, although any suitable stitching pattern may be used. In general, first and second anchor points 44, 48 may be points where stitching extends through sleeve 34 and elastic member 42 to anchor elastic member 42, they may be points where adhesive is used to secure sleeve 34 to elastic member 42, or they may be points where some other form of securement, such as fusing, is used.

In certain applications, it may be useful for elastic member 42 to extend further around the wrist by encircling the medial and lateral points of the wrist and being anchored at the top side of the hand, thus encircling about 270° of the circumference of wrist portion 14.

Although the terms "contained" or "encased" are used to describe the relationship of elastic member 42 to sleeve 34, as shown by comparison of FIGS. 1 and 2, when glove 10 is on a user's hand and slit 36 has spread, a small portion of elastic member 42 is exposed as slit 36 parts. Thus, as used here, the terms "contained" or "encased" should be construed to encompass this operational position of elastic member 42. In addition, while sleeve 34 is illustrated to be made of a solid fabric on both the inside and outside, this should not be interpreted to be the only configuration of the sleeve. More broadly, sleeve 34 is a casing that acts as a guide and pathway for the elastic member and serves to protect the wearer's wrist from chafing or irritation due to stretch and recovery of the elastic member. It will be understood that casing 34 should not be limited to the embodiment illustrated. Casing 34 could be made of a mesh material which exposes elastic member along the circumference. Casing 34 could also be comprised of a series of loops that guide and contain the elastic member. Certainly casing 34 could be formed of a combination of solid fabric on the inside and mesh fabric or other features on the outside. Casing 34 is considered to be within the scope of the invention as long as casing 34 contains and guides elastic member along at least a portion of the wrist circumference.

Since the closure is made of fabric, the fabric layers that form the closure are substantially thinner and more flexible than mating hook and loop fasteners. The overall thickness may vary depending the thicknesses of the casing materials and the elastic member, but any thickness may be used, so long as wrist closure 32 does not unduly impede movement or tactility.

Glove 10 may be manufactured and made available in various sizes to suit users of different hand sizes. Commonly available anthropometric and sizing data can be used to determine both the most advantageous sizes and the relative proportions of glove body portion 12 and wrist portion 14.

It will be realized that glove 10 has certain advantages over other gloves. For example, because wrist closure 32 is one-piece, there is no fastener to close, and glove 10 is thus easier to don. Additionally, there is no hook-and-loop or other type of fastener to become fouled by dirt or debris or to catch on other articles, and to the extent that any portion of elastic member 42 is exposed, exposure of a small portion of elastic member 42 to dirt and debris will not substantially alter its performance. Moreover, the relatively thin and flexible nature of wrist closure 32 lacks the rigidity of other athletic gloves and does not substantially restrict flexibility and range of motion at the wrist.

Figure 6:
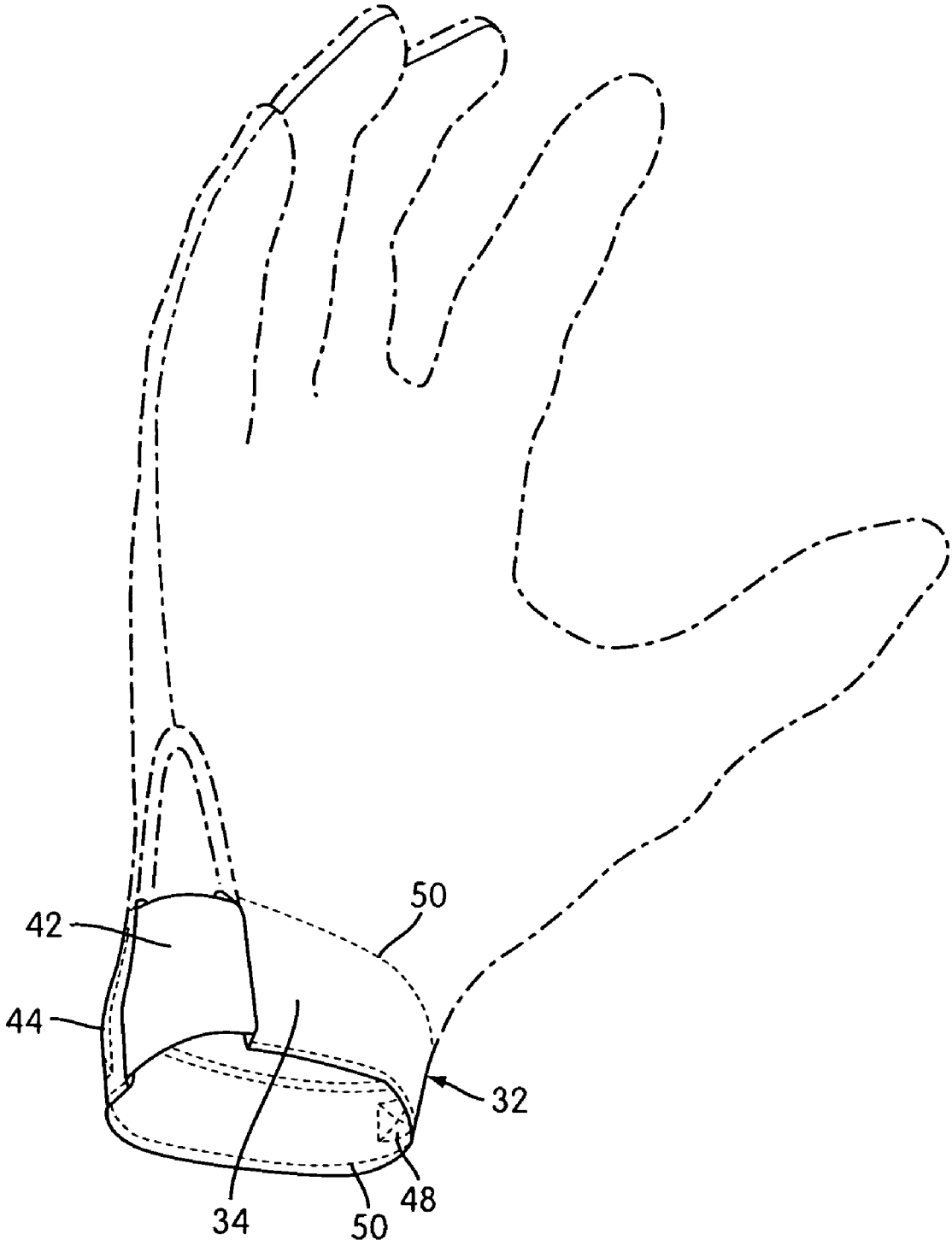
FIG. 6 is a perspective view of a self-closing wrist closure system according to another embodiment of the invention.

Although the foregoing disclosure has described wrist closure 32 in terms of its application to glove 10, it will be realized that wrist closure 32 may be applied to different types of articles. To this end, FIG. 6 illustrates wrist closure 32 in isolation with the glove body shown in phantom lines.

While various embodiments of the invention have been described, it will be apparent to those of ordinary skill in the art that many more embodiments and implementations are possible that are within the scope of the invention.

What is claimed is:

1. A form-fitting athletic glove comprising:

a glove body portion including finger members for receiving each of a wearer's four fingers defining a medial side at the thumb end and a lateral side at the fifth finger end, and defining a palm side and a back side; and a wrist portion including a self-closing wrist closure comprising a sleeve extending around said wrist portion and including a slit therealong extending into said glove body portion, the sleeve being made from a fabric, and a stretchable and recoverable member contained in at least a portion of said sleeve and extending from a first anchor point on said wrist portion to a second anchor point on said wrist portion some distance from said first anchor point so that an exposed portion of the stretchable and recoverable member extends across the slit;

wherein said wrist closure is adapted to enable a wearer's hand to enter the glove by stretching of the elastic member and spreading of said slit and to cinch the wrist portion around the wearer's hand by recovery of the elastic member and narrowing of said slit to provide a tight fit and secure said glove in place.

2. The glove of claim 1, wherein said slit is located on said lateral side.

3. The glove of claim 1, wherein said first anchor point is on said lateral side.

4. The glove of claim 3, wherein said second anchor point is on said medial side.

5. The glove of claim 3, wherein said second anchor point is on said back side.

6. The glove of claim 1, wherein said second anchor point is on said medial side.

7. The glove of claim 1, wherein said elastic member extends in said sleeve along the palm side.

8. The glove of claim 1, wherein said sleeve is made at least in part of a spandex material with stretch and recovery characteristics.

9. The glove of claim 8, wherein said sleeve is made of spandex material on the interior of said palm side.

10. The glove of claim 8, wherein said sleeve is made of neoprene material on the exterior of said palm side.

11. A self-closing wrist closure system for an athletic glove having a glove body defining a palm side, a back side, a medial side and a lateral side, said system comprising:

a sleeve adapted to be attached to the glove body at a wrist portion and extending around said wrist portion, the sleeve being made from a fabric; and a keyhole provided proximate said sleeve for enabling expansion of said wrist portion; and a stretchable and recoverable material at least partially contained in said sleeve and anchored to said sleeve at a first anchor point and a second anchor point some distance from said first anchor point to provide elastic stretch and self-closing recovery properties to said closure system, wherein an exposed portion of the stretchable and recoverable member extends across the keyhole.

12. The closure system of claim 11, wherein said first anchor point is on said lateral side.

13. The closure system of claim 12, wherein said second anchor point is on said medial side.

14. The closure system of claim 12, wherein said second anchor point is on said back side.

15. The closure system of claim 11, wherein said second anchor point is on said medial side.

16. The closure system of claim 11, wherein said elastic member extends in said sleeve along the palm side.

17. The closure system of claim 11, wherein said sleeve is made at least in part of a spandex material with stretch and recovery characteristics.

18. The closure system of claim 17, wherein said sleeve is made of spandex material on the interior of said palm side.

19. The closure system of claim 17, wherein said sleeve is made of neoprene material on the exterior of said palm side.

20. A form-fitting athletic glove comprising:

a glove body portion constructed of stretch material including four finger members for receiving a wearer's fingers and a thumb member for receiving a wearer's thumb, said glove defining a medial side at the thumb member and a lateral side at the fifth finger member, and defining a palm side and a back side; and a wrist portion including a self-closing wrist closure comprising a sleeve made from a fabric extending along said wrist portion and including a V-shaped slit therealong extending into said glove body portion, said slit formed by a stitch line forming a part of the fifth finger member, and a stretchable and recoverable member contained in said sleeve and extending along the palm side from a first anchor point on the back side aligned with the fifth finger member to a second anchor point aligned with the thumb member so that an exposed portion of the stretchable and recoverable member extends across the slit;

wherein said wrist closure enables a wearer's hand to enter the glove by stretching of the elastic member and spreading of said slit and to cinch the wrist portion around the wearer's hand by recovery of the elastic member and narrowing of said slit to provide a secure fit to hold said glove in place.

21. A self-closing wrist closure system for an athletic glove having a glove body defining a palm side, a back side, a medial side and a lateral side, said system comprising:

a sleeve adapted to be attached to the glove body at a wrist portion and extending around at least a portion thereof, the sleeve being made from a fabric;

a keyhole provided proximate said sleeve for enabling expansion of said wrist portion; and a stretchable and recoverable member contained in at least a portion of said sleeve and extending from a first anchor point on said wrist portion to a second anchor point on said wrist portion some distance from said first anchor point, wherein an exposed portion of the stretchable and recoverable member extends across the keyhole, and wherein the stretchable and recoverable member comprises a combination of materials.

* * * * *